United States Patent [19]

Cairns et al.

[11] 4,221,456

[45] Sep. 9, 1980

[54] FUSE HOLDER FOR AN AUTOMOTIVE FUSE TERMINAL BLOCK

[75] Inventors: Thomas M. Cairns, Birmingham; John H. Dewar, Grosse Ile; Emmons F. Sumner, Ann Arbor, all of Mich.

[73] Assignee: Ford Motor Company, Dearborn, Mich.

[21] Appl. No.: 16,580

[22] Filed: Mar. 1, 1979

[51] Int. Cl.[3] ..... H01R 11/22; H01R 15/12

[52] U.S. Cl. ..... 339/223 R; 339/276 SF; 339/258 F

[58] Field of Search ..... 339/198 H, 198 P, 223 R, 339/150 F, 173, 219 F, 252 F, 258 R, 258 F, 262 F, 253 F, 270 F, 276 SF

[56] References Cited

U.S. PATENT DOCUMENTS

| | | | |
|---|---|---|---|
| 2,938,190 | 5/1960 | Krehbiel | 339/223 R |
| 2,982,938 | 5/1961 | Klumpp | 339/223 R X |
| 4,097,109 | 6/1978 | Cross | 339/258 F X |

*Primary Examiner*—Roy Lake

*Assistant Examiner*—Eugene F. Desmond

*Attorney, Agent, or Firm*—Peter Abolins; Clifford L. Sadler

[57] ABSTRACT

This specification discloses a fuse holder for an automotive terminal block for receiving fuses and electrical connections to various electrical components of the automobile. The fuse holder is positioned within the terminal block and is adapted to receive the blade contact of a fuse thereby establishing an electrical connection to the fuse. Typically, the fuse holder has a spring clip with two prongs spring biased against one another so that the blade contact can be resiliently secured between two prongs. The fuse holder can have a pair of attaching prongs to hold a wire providing an electrical connection to the fuse holder. A stop tab is positioned adjacent the attaching prongs so that a wire slipped between the attaching prongs is limited in movement toward the spring clip of the fuse holder so that it does not interfere with entry of the fuse blade between the two prongs.

5 Claims, 3 Drawing Figures

FUSE HOLDER FOR AN AUTOMOTIVE FUSE TERMINAL BLOCK

BACKGROUND OF THE INVENTION (1) Field of the Invention

This invention relates to electrical connectors; and, more particularly, to the fuse holder within an automotive terminal block which removably secures various connections.

(2) Prior Art

Automobiles typically have a fuse terminal block which is mounted adjacent the instrument panel or forward fire wall to provide a means for securing fuses and for providing connections to various electrical components of an automobile such as headlights, horns, power seats, power windows and numerous electrical options which can be customer selected.

It is particularly desirable that electrical connection can be made to the fuse holder in a rapid and secure manner. The connection should also be such that there is no interference with the insertion of a fuse blade contact into a spring holding clip of a fuse holder. To satisfy the needs of rapid and simple mass production, the connection of an electrical conductor to the fuse holder should be completely "fool proof". Because of the desire of the fabricator to use "short cuts" or to otherwise complete the job as quickly as possible without adequate assurance of quality of the completed fuse holder, designing a connection configuration to the fuse holder has presented problems. Further it is desirable to make a fuse holder which uses as little material as possible for a given current carrying capacity as possible and yet has a desired strength. These conflicting requirements have long posed a problem to designers of fuse holders.

For example, one known configuration taught in U.S. Pat. No. 4,097,109 includes a core (or conductor) crimp pair of wings and an insulation crimp pair of wings which are spread apart longitudinally (along the length of an attached wire) to incorporate an integral, transversely extending bus bar portion. A wire lead is crimped between the wings. Aligned with the wire lead are spring clips with the opposing prongs forming a female contact portion for receiving therebetween the blade of a fuse. Incorrect positioning of the wire terminal in the fuse holder can cause the ends of the wire lead to interfere with the female portion or spring. Such interference can cause (1) deflection of the spring thereby misaligning it with a fuse blade, (2) holding the spring in closed position when strands of the terminal wire are on each side of the prong thereby making insertion of the fuse blade contact difficult, and (3) opening of the spring by insertion of the terminal wire sufficiently far into the spring so that it goes between the prongs and spreads them apart. When the wire enters between the prongs and spreads them apart not only does it make insertion of the fuse blade contact difficult because of interference of the wire ends, but it may lead to poor contact or intermittent contact which is difficult to detect and repair. These are some of the problems this invention overcomes.

SUMMARY OF THE INVENTION

This invention recognizes that a fuse holder for use in a terminal block for fuses having blade contacts has a pair of attachment means for attaching a wire to the fuse holder and includes a stop means longitudinally aligned with the wire to be connected and positioned between the wire and two prongs of the fuse holder, i.e., spring clips, adapted for holding therebetween a fuse blade contact. The stop means limits the travel of a wire toward the prongs when the wire is being positioned for connection. As a result, portions of the wire do not become entangled between the prongs and impede connection to the blade contact to the fuse holder. The assembly of the terminal connection to the fuse holder as well as the connection of the fuse to the fuse holder is made substantially simpler and less prone to error. The result is improved reliability and ease of fabrication.

This invention further recognizes that a double current path between adjacent spring clips can increase the current carrying capacity from a wire lead to spring clips along the fuse holder. By providing two paths there is a reduction in the heat generated and an increase in the electrical current rating of the fuse holder.

DETAILED DESCRIPTION OF THE INVENTION

Figure 2:
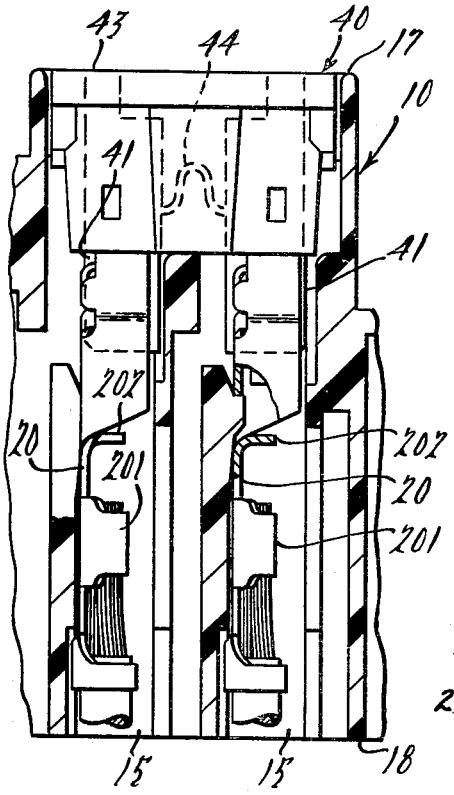
FIG. 2 is a side, partly section, view of a fuse holder positioned in a terminal block in accordance with an embodiment of this invention.
Figure 3:
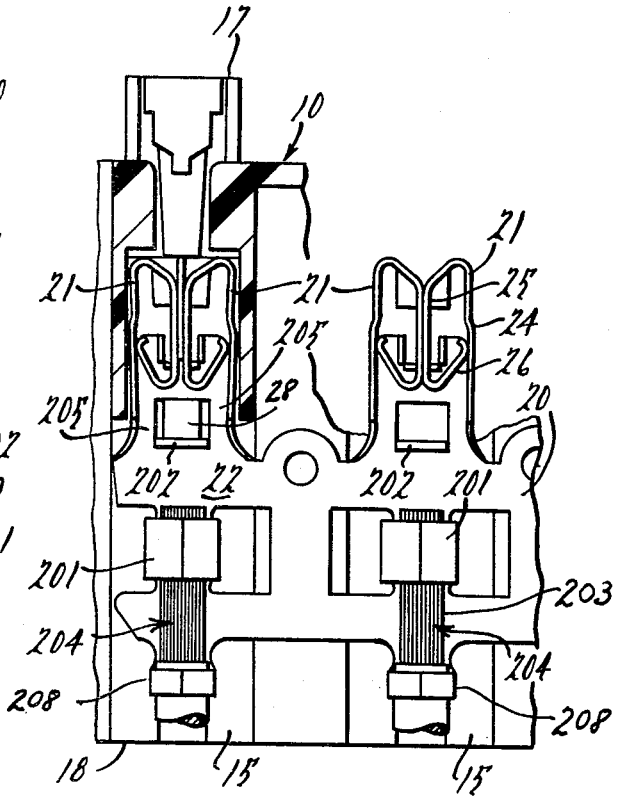
FIG. 3 is a front, partly section, view of the assembly in FIG. 2 showing a stop tab separating the attaching prongs of the terminal wire from the spring clips for holding the fuse blade contact.

Referring to FIGS. 2 and 3, a terminal block has the general shape of a rectangular solid with a plurality of passages 15 extending therethrough between a front (or top) surface 17 and a rear (or bottom) surface 18. At least some of passages 15 from top surface 17 of terminal block 10 are designed to receive a fuse 40 having a pair of spaced blade contacts 41. Fuse 40 is advantageously a miniature plug-in fuse similar to that described in U.S. Pat. No. 3,909,767 issued September 30, 1975 and assigned to Littlefuse, Inc. At least some of passages 15 are accessible from bottom surface 18 of terminal block 10 and are adapted to receive a fuse holder 20 as shown in FIGS. 2 and 3. Further, various accessory connections can be made from the bottom or top of terminal block 10 to fuse holder 20 or, in some cases, directly to blade contacts 41 of fuse 40.

Figure 1:
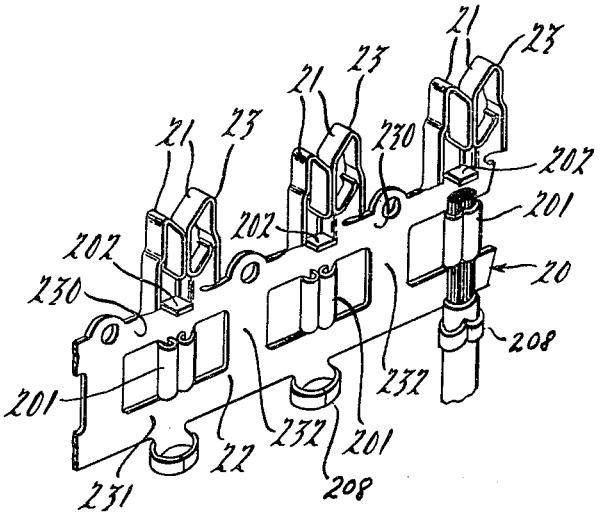
FIG. 1 is a perspective view of a fuse holder in accordance with an embodiment of this invention.

Fuse holder 20 has a longitudinally extending bus bar 22 having laterally extending spring clips 23, each having a pair of prongs 21 (FIG. 1). Fuse holder 20 typically has a plurality of spring clips 23 along its length and at least a pair of attaching prongs 201 for connecting to a conducting wire 203. Prongs 21 have an outside portion 24, an intermediate portion 25 and an end portion 26 (FIG. 3). Between outside portion 24 and intermediate portion 25 there is a fold or bend and there is another fold or bend between intermediate portion 25 and end portion 26. Accordingly, spring clip 23 comprises two prongs 21 which are folded back on themselves twice so that the end portions 26 of each prong 21 bear resiliently against the outside portions 24 and the intermediate portions 25 of the two prongs 21 bear against each other. In use, a blade contact 41 of fuse 40 is held resiliently between intermediate portions 25 of the two prongs 21. Fuse holder 20 also includes an opening 28 associated with each spring clip 23 which acts in cooperation with a portion of terminal block 10 to secure fuse holder 20 in terminal block 10.

Fuse 40 is relatively small, flat element which includes a flat sheet metal stamping 42 partially situated within a plastic housing 43 (FIG. 2). Stamping 42 includes a fuse element 44, and blade contacts 41 which are a pair of laterally spaced protruding contact elements which are to be received between prongs 21 of spring clip 23 which is part of fuse holder 20.

Additional description of the above described fuse terminal block assembly is found in the following copending applications filed on even date herewith, the disclosures of which are hereby incorporated by reference: Title of I—Terminal Block with Electrical Connection Means with Connector Location Wall and Locking Finger, Ser. No. 16,468. Title of II—Fuse Holder With Entry Control, Ser. No. 16,468. Title of III—Fuse Terminal Block With Alternative Means For Connecting Two Fuse Blades, Ser. No. 16,474. Title of IV—Terminal Block With Fuse Guards and Identification Surface, Ser. No. 16,743. Title of VII—Fuse Holder with Insertion Ramp, Ser. No. 16,579.

This invention is directed toward a generally rectangular planar stop tab 202 which is positioned between spring clip 23 and attaching prongs 201 along a plane separating them. Attaching prongs 201 are spaced extensions for crimping therebetween the exposed conducting wire 203 of an electrical lead 204 to be connected to fuse holder 20.

Stop tab 202 is particularly advantageous because it can be integrally formed of the material used to form fuse holder 20. That is, fuse holder 20 can be formed in a progressive die and can include the step of folding stop tab 202 thereby forming an opening 28 which is useful in retaining fuse holder 20 in terminal block 10.

This invention is also directed to recognizing that sufficient cross sectional area must be maintained on either side of stop tab 202, in a current conducting area 205, so that sufficient current can be carried between conducting wire 203 and spring clip 23. That is, it must be recognized that folding stop tab 202 takes away a portion of the conducting cross section and limits the conducting cross section at stop tab 202 to the current conducting area 205.

Fuse holder 20 includes a current path 230 and a current path 231 which are parallel extensions along bus bar 22 and have spaced, transverse reinforcing members 232. Alternate ones of reinforcing members 232 support attaching prongs 201. As a result, current flow from conducting wire 203 connected to attaching prongs 201 can flow down bus bar 22 along two current paths 230 and 231. This increases reliability by providing alternate paths and increases the cross section through which current can flow from conducting wire 203.

Referring to FIGS. 1 and 3, a pair of securing prongs 208 are positioned on the opposite side of current path 231 from attaching prongs 201. Securing prongs 208 grasp the insulation of electrical lead 204 and provide additional support for electrical lead 204. The spacing of securing prongs 208 from attaching prongs 201 is sufficient to permit access to conducting wire 203 by current path 231.

A typical material for fuse holder 20 is CDA-194 copper alloy. A typical length for prongs 201 is 0.30 inches. A typical width for stop tab 202 is 0.13 inches, with a spacing of 0.13 inch from the bottom fold of prongs 201 and a spacing of 0.12 inch from the top of attaching prongs 201.

Various modifications and variations will no doubt occur to those skilled in the various arts to which this invention pertains. For example, the particular shape of the stop tab may be varied from that disclosed herein. These and all other variations which basically rely on the teachings through which this disclosure has advanced the art are properly considered within the scope of this invention.

We claim:

1. A fuse holder for use in a terminal block for providing connection between an automobile electrical system and fuses used in connection with the automotive electrical system, said fuses being of a miniature nature and having a pair of blade contacts, said fuse holder having a spring clip with a pair of prongs adapted for holding therebetween a blade contact of said fuse and a pair of attachment means for attaching an electrically conductive wire to said fuse holder;

said fuse holder further including a stop means longitudinally aligned with the wire to be connected and positioned between the wire and said two prongs of said fuse holder so that portions of said wire do not interfere with said prongs and impede connection to said blade contact of the fuse;

said fuse holder includes a plurality of spring clips, each having a laterally extending bus bar portion which together form an elongated bus bar from which said spring clips extend at spaced intervals;

said elongated bus bar having a first elongated path and a second elongated path, said first and second paths being generally parallel with spacing therebetween, said first and second elongated paths being connected by spaced reinforcing members extending between said first and second paths; and at least some of said spaced reinforcing members having extending therefrom a pair of attaching prongs for receiving the electrically conducting wire of a lead to be connected to said fuse holder so that when an electrical wire is attached to said fuse holder by said attaching prongs, electrical access to said electrical lead is available both through said first path and said second path, thereby, for a given fuse holder width, increasing the current carrying capacity of said fuse holder in comparison to a fuse holder having a single path.

2. A fuse holder as recited in claim 1 further comprising a pair of securing prongs which are positioned on the other side of said second conducting path from said attaching prongs, said securing prongs being aligned with said attaching prongs so that said securing prongs can grasp the insulating material surrounding the wire lead, thereby improving the physical connection between said fuse holder and said wire lead.

3. A fuse holder as recited in claim 2 wherein said securing prongs, said attaching prongs and said spring clips are aligned.

4. A fuse holder as recited in claim 3 wherein said stop means is longitudinally aligned with said attaching prongs so that said stop means prevents inadvertent insertion of said wire lead into said spring clip.

5. A fuse holder as recited in claim 4 wherein only alternate reinforcing members include attaching prongs.

* * * * *